United States Patent [19]

Shanton

[11] Patent Number: 4,574,294

[45] Date of Patent: Mar. 4, 1986

[54] RECORD MATERIAL

[75] Inventor: Kenneth J. Shanton, Beaconsfield, England

[73] Assignee: The Wiggins Teape Group Limited, Hampshire, England

[21] Appl. No.: 621,100

[22] Filed: Jun. 15, 1984

[30] Foreign Application Priority Data

Jun. 15, 1983 [GB] United Kingdom ..... 8316233

[51] Int. Cl.[4] ..... B41M 5/16; B41M 5/18; B41M 5/22

[52] U.S. Cl. ..... 346/210; 346/212; 346/216; 346/225; 427/150; 427/151

[58] Field of Search ..... 346/210–212, 346/216, 217, 225, 218; 427/150–152

[56] References Cited

U.S. PATENT DOCUMENTS

| | | | |
|---|---|---|---|
| 2,663,656 | 12/1953 | Miller et al. | 428/913 |
| 3,432,327 | 3/1969 | Kau et al. | 346/200 |
| 4,124,227 | 11/1978 | Ruus | 346/218 |
| 4,315,068 | 2/1982 | Kunikane et al. | 430/341 |
| 4,351,956 | 9/1982 | Cesark et al. | 427/150 |

FOREIGN PATENT DOCUMENTS

| | | | |
|---|---|---|---|
| 0035773 | 9/1981 | European Pat. Off. | 346/218 |
| 2161202 | 6/1972 | Fed. Rep. of Germany | 346/214 |
| 2353525 | 5/1977 | France | 346/218 |
| 1373527 | 11/1974 | United Kingdom | 346/214 |

*Primary Examiner*—Bruce H. Hess

*Attorney, Agent, or Firm*—Burns, Doane, Swecker & Mathis

[57] ABSTRACT

Record material of the type in which the color forming reaction is between an electron donating chromogenic material and an electron accepting color developer uses one or more metal/oximes as the color developer. Preferred oximes are monoximes, especially salicylaldoxime and its ring substituted derivatives, and dioximes such as dimethylglyoxime and mioxime and the preferred metal is zinc. Metal oximate salts can be used especially the salicylaldoximate, diphenylglyoximate and benzaldoximates of zinc.

10 Claims, No Drawings

RECORD MATERIAL

This invention relates to pressure sensitive record material, a record receiving sheet for use therewith, and heat sensitive record material. In particular it relates to such record material including at least one metal/oxime electron accepting colour developer.

Pressure sensitive record material generally employs a colour forming reaction involving a substantially colourless chromogenic material, a colour developer capable of reacting with the chromogenic material to produce a colour, and a solvent in which the colour forming reaction can take place. The reactive components of the colour forming reaction are kept apart by a pressure sensitive barrier until such time as the record material is used. The barrier may be a continuous honeycombed structure but more usually takes the form of microcapsules. In either case, a solvent solution of one of the reactive components, normally the chromogenic material, can be isolated within the honeycombed structure or the microcapsules. In use, the application of pressure to the record material causes rupture of the barrier in the area immediately subject to such pressure and subsequent release of the solvent solution of one of the reactive components. The solution then reacts with the other of the reactive components to produce a coloured image which corresponds to the pattern of applied pressure. In this way, pressure sensitive record material can be used to provide copies without the need for carbon paper.

With a self-contained record system, the record material comprises a sheet coated, or having dispersed within, a mixture of the chromogenic material and the colour developer, one of which is isolated as a solvent solution from the other by a pressure sensitive barrier. With a transfer record system, the record material comprises at least two sheets—the transfer or "coated back" (CB) sheet and the record receiving or "coated front" (CF) sheet. The CB sheet is coated with a solvent solution of one of the reactive components, the solution being isolated by a pressure sensitive barrier, and the CF sheet is coated with the other of the reactive components. The CB and CF sheets are assembled together with their coatings in contiguous relationship so that transfer of the solvent solution can take place from the CB to the CF sheet. Further copies can be obtained by including further sheets which are coated on one side with a solvent solution of one of the reactive components, the solution being isolated by a pressure sensitive barrier, and coated on the other side with the other of the reactive components. Such sheets, which are referred to as "coated front and back" (CFB) sheets, are placed between the CB and CF sheets with each coating of one of the reactive components being in contiguous relationship with a coating of the other of the reactive components. If the reactive component which is isolated as a solvent solution by a pressure sensitive barrier is the chromogenic material, the system is the normal transfer record system. If, however, the isolated reactive component is the colour developer, the system is then referred to as the reverse transfer record system.

Heat sensitive record material employs a colour forming reaction that is responsive to a temperature change. The reactive components of the colour forming reaction include a substantially colourless chromogenic material or the colour developer or another component, such as a wax, being capable of melting and/or vaporising at an elevated, thermographically suitable temperature to allow reaction of the chromogenic material and the colour developer to proceed. Heat sensitive record material comprises a sheet having a coating in which both reactive components are dispersed in a binder. In use a suitable imaging tool is applied to the coated surface of the record material and, at an elevated temperature, produces a coloured image which corresponds to the pattern of applied heat.

There are many chromogenic materials known for use in pressure and heat sensitive colour forming reactions. These materials are organic compounds which develop their coloured form by acquiring a positive charge engendered by the colour developer. Important examples include the organic phthalides, fluorans, di- and tri-arylmethanes, spirodipyrans and benzoyl phenoxazines and phenothiazines. In addition, it is known that certain derivatives of oximes are useful as chromogenic material (European Patent Specification No. 0035773). Suitable colour developers for such chromogenic materials are also known. In the case of pressure sensitive colour forming systems, there are phenolic resins, acidic clays and salicylic acid derivatives. In the case of heat sensitive colour forming systems, there are notably phenolic compounds.

In addition, pressure sensitive colour forming reactions are known in which colour formation is achieved by reaction of a metal cation, usually a transition metal cation, with a chelating agent to give a coloured metal complex. Examples of suitable chelating agents include various oximes (U.S. Pat. No. 2,663,656 and Japanese Patent Publication Nos. 41-2612, 49-43566 and 50-16970). It is also known to achieve colour formation by reacting a microencapsulated solution of a substantially colourless metal oximate with another metal (Japanese Patent Publication No. 49-27133). The term "chromogenic material" is not normally applied to any of the components of this type of system.

It has now been found that a metal or a metal salt and an oxime, either as a mixture or as a metal oximate salt, are useful colour developers of the aforementioned chromogenic materials, and are suitable for use in both pressure and heat sensitive record materials.

The present invention therefore provides pressure sensitive record material in which the colour forming reaction is produced from a substantially colourless chromogenic material capable of acquiring a positive charge to produce its coloured form and a metal/oxime colour developer capable of engendering the acquisition of a positive charge by the chromogenic material, the chromogenic material and the colour developer being isolated from each other by a pressure sensitive barrier.

The present invention also provides heat sensitive record material in which the colour forming reaction is produced from a substantially colourless chromogenic material capable of acquiring a positive charge to produce its coloured form and a metal/oxime colour developer capable of engendering the acquisition of a positive charge by the chromogenic material the chromogenic material or the colour developer or another component, such as wax, being capable of melting and/or vaporising at a thermographically suitable temperature to allow the colour forming reaction to take place.

As used herein the expression "metal/oxime" means either a mixture of a metal or metal salt and an oxime, or a metal oximate. Such mixtures and oximates are synergistic in their reactivity in that they are more reactive than the sum of the reactivities of their component parts.

A suitable oxime for use in the present invention can be a monoxime or a dioxime. A preferred class of monoxime colour developers is of formula (I):

$$(R_1)(R_2).C{=}N{-}OH \quad (I)$$

wherein $R_1$ and $R_2$ are the same or different and each represents a hydrogen atom; an alkyl group; an aryl, especially a phenyl or a naphthyl, group which is optionally substituted by one or more hydroxy and/or alkyl and/or aralkyl and/or alkoxy and/or halo substituent(s); an aroyl group; an acyl group; an aralkyl group, especially a 1-aryl-1-hydroxymethyl group; a hydroxy group; or $R_1$ and $R_2$ together with the carbon atom to which they are bonded represent an alicyclic or heterocyclic ring which may be aromatic or non-aromatic and preferably contains 5 or 6 atoms in the ring.

A preferred class of dioxime colour developers is of formula (II)

$$HO{-}N{=}C(R_3){-}(R_4)C{=}N{-}OH \quad (II)$$

wherein $R_3$ and $R_4$ are the same or different and each represents a hydrogen atom; an alkyl group; an aryl, preferably phenyl, group; a furyl group or $R_3$ and $R_4$ together represent a $C_1$ to $C_{10}$, preferably a $C_3$ to $C_5$, and especially a $C_6$, alkylene group.

The alkyl groups or the alkyl moieties of alkyl-conaining groups used in the oximes of formulae (I) and (II) usually have from 1 to 20, for example from 1 to 12, and 1 to 5, carbon atoms. Such groups or moieties moreover may have straight or preferably branched chains, such as t-nonyl or t-butyl. Of the straight chain groups or moieties, methyl is generally preferred. Where the alkyl group(s) is a substituent in an aryl group attached to the oxime function, the alkyl group(s) may be long chain e.g. $C_{10}$ to $C_{20}$, straight or branched, alkyl groups.

Examples of suitable oximes of the formula (I) include acetoxime (acetone oxime), acetaldoxime (acetaldehyde oxime), acetophenone oxime, biacetyl monoxime (2,3-butanedione 2-oxime), cyclohexanone oxime, benzoin oxime, 1-phenyl-1,2-propanedione 2-oxime, 2-hydroxyphenyl oximes such as salicylhydroxamic acid (N,2-dihydroxybenzamide) and salicylaldoxime, and especially their 3-,5- and 3,5-dialkyl and aralkyl substituted derivatives e.g. 2-hydroxy-5-t-nonylacetophenone oxime and 3,5-di-t-butyl salicylaldoxime, and violuric acid (5-oximinobarbituric acid or 2,4,5,6 (1H,3H)-pyrimidinetetrone 5-oxime).

Examples of suitable oximes of formula (II) include glyoxime (glyoxal dioxime or ethanedione dioxime), dimethylglyoxime (2,3-butadione dioxime), diphenylglyoxime (benzil dioxime or 1,2-diphenylethanedione dioxime), alpha-furildioxime (di-2-furanylethanedione dioxime) and 1,2-cyclohexanedione dioxime (commonly known as nioxime).

The most preferred oximes are monoximes of the formula (I) in which one of $R_1$ and $R_2$ is a hydroxyphenyl, preferably a 2-hydroxyphenyl, most preferably a 3-,5- or 3,5-di-alkyl, preferably branched chain $C_3$ to $C_{10}$, or di-aralkyl, preferably alpha-phenylalkyl, substituted 2-hydroxyphenyl, group and the other is alkyl or, preferably, hydrogen. Especially preferred are the oximes of salicylaldehyde and its ring-substituted derivatives.

A large number of the oximes of formulae (I) and (II) are known and commercially available, for example as metal extractants. Those that are not can be prepared in an analogous manner to the preparation of the known oximes. Generally this involves the treatment of the corresponding carbonyl containing compound with hydroxylamine. The aldehyde or ketone can in turn be prepared by published synthetic routes.

A single metal/oxime or a combination of different metal/oximes may be used as the colour developer of the present invention. Moreover, one or more metal/oximes may be used with one or more other, known colour developers, such as acidic clays, phenolic resins and salicylic acids.

Examples of suitable metals for use in the metal/oxime colour developer include aluminium (Al), calcium (Ca), cobalt (Co), chromium (Cr), copper (Cu), iron (Fe), potassium (K), magnesium, (Mg), manganese (Mn), molybdenum (Mo), sodium (Na), niobium (Nb), nickel (Ni), tin (Sn), tantalum (Ta), titanium (Ti), tungsten (W), zirconium, (Zr) and, preferably, zinc (Zn). Typically, the metal will be provided to the metal/oxime colour developer as a salt of an acid or similar compound e.g. an oxide or hydroxide. One or more of these metals may be used with one or more oximes as the metal/oxime colour developer. Although the present invention is not limited to a metal/oxime colour developer having a particular colour, it is generally preferred that the colour developer is substantially white. The use of metal-oxime combinations likely to give rise to highly coloured complexes e.g. nickel and dimethyl glyoxime will generally be avoided.

When a mixture is employed for the metal/oxime colour developer, it is preferred to use the metal in the form of a salt. Zinc nitrate, chloride or sulphate is the most preferred especially when used with an oxime in a molar ratio from 5:1 to 2:3 especially 4:1 to 1:1.

The amount of metal/oxime used as a colour developer will typically be in the range 0.05 to 3 $gm^{-2}$, more usually 0.1 to 1.5 and 0.3 to 1 $gm^{-2}$. The optimum may vary within the broad limits depending on the configuration of the system (pressure sensitive—normal transfer, reverse transfer or self contained—or heat sensitive) and the other materials present. As the quantities of oxime are relatively small, direct coating onto a substrate e.g. to make a CF sheet, can be difficult to achieve uniformly and, accordingly, the metal/oximes will usually be coated in conjunction with a carrier. For CF sheets the metal/oxime will usually be coated or deposited onto the carrier e.g. by solvent evaporation deposition or precipitation. For heat sensitive sheets the metal/oxime and carrier will typically be co-dispersed. Suitable carriers include inert inorganic and organic particulate materials, especially pigments, such as china clay, talc, alumina, and agglomerated cross-linked urea-formaldehyde resin pigments, and non-inert carriers where the carrier provides the or some of the metal to form the metal/oxime combination e.g. zinc oxide and calcium carbonate. As zinc is a particularly effective metal for modification of the oximes zinc oxide is an especially useful carrier, in particular of salicylaldoxime and substituted salicylaldoximes. The metal/oxime colour developer will usually be from 1 to 20% by weight of the carrier. The carrier and metal/oxime can be coated onto the substrate using conventional binders such as starch, styrene-butadiene latex and, particularly for heat sensitive record material, thermofusible binders such as polyvinyl alcohol. The overall coatweight will typically be from 3 to 15 more usually 5 to 10 $gm^{-2}$.

If a metal oximate is employed for the metal/oxime colour developer, it is preferred to use a salicylaldoximate especially a substituted salicylaldoximate as described above, diphenyl glyoximate or benzaldoximate of zinc. Such oximates can be produced by reacting a zinc salt with the oxime in solution and precipitating the oximate.

The other reactive component to be used in the colour forming reaction with the metal/oxime colour developer is the substantially colourless chromogenic material. The present invention is not limited to any particular type of chromogenic material as long as its coloured form is dependent on the acquisition of a positive charge in the presence of the colour developer. Suitable chromogenic materials include azacyclic furanones such as 7-(1-ethyl-2-methylindol-3-yl)-7-(4-diethylamino-2-ethoxyphenyl)-5,7-dihydrofuro[3,4-b]pyridin-5-one (pyridyl blue), diarylmethane derivatives such as Michler's hydrol para-toluene sulphonate, (bis-(4-dimethylaminophenyl)methane 4-methylbenzenesulphonate), fluorans such as 3-cyclohexylamino-6-chlorofluoran, 3-diethylamino-7,8-benzofluoran, 3-diethyl amino-6-methyl-7-chlorofluoran, and including particular 3,7-diamino-substituted fluorans such as 3-diethylamino-6-methyl-7-N-phenylaminofluoran (N-102), 3-N-ethyl-N-(4-methylphenyl)amino-6-methyl-7-N-phenylaminofluoran, 3-N-ethyl-N-(4-methylphenyl-)amino-7-N-phenylaminofluoran and 3-diethylamino-7-dibenzylamino fluoran, phthalides such as 3,3-bis-(4-dimethylaminophenyl)-6-dimethylaminophthalide (CVL), 3,3-bis-indolyl phthalides such as 3,3-bis-(1-ethyl-2-methylindol-3-yl)phthalide, (Indolyl Red), 3,3-bis-(1-n-octyl-2-methylindol-3-yl)phthalide, 3,3-bis-indolyltetrachlorophthalides such as 3,3-bis-(1-ethyl-2-methylindol-3-yl)-4,5,6,7-tetrachlorophthalide (and its 1-n-octyl analogue) triarylmethane derivatives such as those disclosed in U.S. Pat. No. 4,154,463, for example di-(4-N-methyl-N-phenylaminophenyl)-N-butylcarbazol-3-yl methane (DMBM), phenoxazines such as 3,7-bis-diethylamino-10-benzoylphenoxazine (BLASB), phenothiazines such as 3,7-bis-dimethylamino-10-benzoylphenothiazine (BLMB), substituted pyridines such as 2,6-diphenyl-4-(4-N-methyl-N-phenylaminophenyl)-pyridine, Rhodamine derivatives such as the N-(2- or 4-chlorophenyl)derivatives of Rhodamine-B-lactam (N-(2- or 4-chlorophenyl)-3,4'-spiro(3,6'-bis-(diethylamino)xanthane)phthalan), chromenopyrazoles such as those disclosed in British Pat. No. 1469515 and spirodipyrans such as those disclosed in British Pat. No. 1460503 and European Patent Specification No. 0010740, for example 3'-phenyl-7-diethylamino-2,2'-spiro-di-(2H-1-benzopyran) (PDSB).

To obtain an image with the desired colour and physical characteristics, the record material customarily and pressure sensitive record material in particular uses a combination of different chromogenic materials each contributing to the overall effect. Thus, for a blue image, a combination of CVL, which is a fast developing blue chromogenic material but which also fades relatively quickly, with BLMB, which is a slow developing blue chromogenic material that does not fade so quickly, is often used. And to obtain an image with other desired characteristics, such as photocopiability, a green and/or a red chromogenic material are sometimes used as well.

The present invention extends to the use of combinations of chromogenic materials as well as to the use of single chromogenic materials in both pressure and heat sensitive record material.

With pressure sensitive material embodying the aforementioned self-contained and normal transfer systems, and also using the much preferred microcapsular form of pressure sensitive barrier, the chromogenic material, alone or with other chromogenic materials, is normally dissolved in a suitable organic solvent prior to microencapsulation. Examples of such solvents which may optionally be used in combination include dialkyl phthalates such as diethyl, dibutyl, dioctyl, dinonyl and ditridecyl phthalates, partially hydrogenated terphenyls, alkylated naphthalenes, 2,2,4-trimethyl-1,3-pentanediol di-isobutyrate (TXIB, U.S. Pat. No. 4,027,065), ethyl-diphenylmethane (U.S. Pat. No. 3,996,405), alkyl biphenyls such as mono-isopropyl-biphenyl (U.S. Pat. No. 3,627,581), higher alkyl benzenes such as dodecyl benzene, diaryl ethers such as diphenyl ether, di(aralkyl) ethers, such as dibenzyl ether, aryl aralkyl ethers such as phenyl benzyl ether, liquid dialkyl ethers having at least eight carbon atoms, liquid alkyl ketones having at least nine carbon atoms, alkyl or aralkyl benzoates such as benzyl benzoate, trialkylphosphates, kerosene and Magnaflux oil, which is a mixture of saturated aliphatic hydrocarbon oils having a distillation temperature in the range of from 320° to 550° F. (160° to 288° C.). Of course, the solvent should not only be capable of dissolving the chromogenic material but should also be able to maximise contact between the chromogenic material and the oxime colour developer so as to permit the colour forming reaction to proceed. The preferred solvents for use with the present invention include partially hydrogenated terphenyls and dialkylphthalates. Optionally these solvents are used in combination with a diluent such as kerosene.

The chromogenic solution is microencapsulated in accordance with processes known in the art, such as those disclosed in U.S. Pat. Nos. 2,800,457, 3,041,289, 3,533,958, 3,755,190, 4,001,140, 4,100,103 and 4,105,823. Coating formulations and processes for the preparation of pressure sensitive record material are known in the art, for example U.S. Pat. Nos. 3,627,581, 3,775,424 and 3,853,869.

The present invention also provides a record receiving sheet suitable for use with pressure sensitive record material embodying the normal transfer system, which comprises a sheet coated with a metal/oxime colour developer. A process of preparing such a record receiving sheet comprises coating a sheet with a coating formulation containing a metal/oxime colour developer.

The present invention additionally provides pressure sensitive record material embodying the normal transfer system, which comprises a transfer sheet coated with a microencapsulated solution of a substantially colourless chromogenic material capable of acquiring a positive charge to produce its coloured form and a record receiving sheet coated with a metal/oxime colour developer capable of engendering the acquisition of a positive charge by the chromogenic materials, the transfer and record receiving sheets being arranged with the coatings in contiguous relationship.

The present invention further provides pressure sensitive record material embodying the self-contained system, which comprises a sheet coated, or having dispersed within, a mixture of a microencapsulated solution of a substantially colourless chromogenic material capable of acquiring a positive charge to produce its coloured form and a metal/oxime colour developer capable of engendering the acquisition of a positive charge by the chromogenic material.

The metal/oxime colour developers are also suitable for use in pressure sensitive record material embodying the reverse transfer system, as described in British Pat. No. 1337924. Thus the present invention provides pressure sensitive record material, which comprises a transfer sheet coated with a microencapsulated solution of an oxime colour developer and a record receiving sheet coated with a substantially chemically inert pigment on which is adsorbed a substantially colourless chromogenic material capable of acquiring a positive charge in the presence of the colour developer to produce its coloured form the transfer and record receiving sheets being arranged with the coatings in contiguous relationship.

With heat sensitive record material, coating formulations and processes for its production are generally known in the art, for example U.S. Pat. Nos. 3,539,375, 3,674,535 and 3,746,675. In this regard, the present invention provides heat sensitive record material which comprises a sheet coated with a thermally responsive composition containing a substantially colourless chromogenic material capable of acquiring a positive charge to produce its coloured form and a metal/oxime colour developer capable of engendering the acquisition of a positive charge by the chromogenic material, the chromogenic material or the colour developer or another component, such as a wax, being capable of melting and/or vaporising at a thermographically suitable temperature to allow the colour forming reaction to take place.

The invention is illustrated by the following Examples. All parts and percentages are by weight unless otherwise stated. The "C.O.I Reflectometer" used in the Examples is as described in U.K. Patent Specification No. 2054845A.

EXAMPLE 1

Three coating formulations were made up with the following ingredients:

| Ingredients | Amount (Parts) | | |
|---|---|---|---|
| | A | B | C |
| Salicylaldoxime | 20.4 | 26.2 | 39.3 |
| Zinc Sulphate heptahydrate | 42.6 | 54.8 | 82.2 |
| Dinkie A (China clay) | 81.0 | 81.0 | 81.0 |
| Dow latex binder | 14.4 | 14.4 | 14.4 |
| Water | 141.5 | 141.5 | 141.5 |

In formulations A, B and C the ratios of Dinkie A to zinc sulphate/salicylaldoxime were respectively 3:2, 1:1, 2:3, and the molar ratio of salicylaldoxime to zinc sulphate was 1:1 for each formulation.

Formulations A, B and C were ball-milled for one-hour, adjusted to a pH of 7.0 and then coated on sheet paper with a laboratory Meyer coater. The resulting sheets A, B and C were then oven dried to give dry coatweights of about 10 $gm^{-2}$.

The sheets were each separately contacted with 1% chromogenic solutions in 4:1 partially hydrogenated terphenyl:kerosene of CVL,N-102 and BLASB. After 2 minutes, the reflectance of the image and the reflectance of the unimaged area was measured using a C.O.I. Reflectometer. The colour intensity (C.I.) of the image was determined by dividing the reflectance of the image by the reflectance of the unimaged area and expressing the result as a percentage. The lower the percentage the more intense the developed colour. The colour intensity of the image was also determined after placing the imaged sheets for 30, 90 and 180 minutes in a fade cabinet containing an array of six fluorescent light tubes positioned above the sheets. The results are set out in Table 1 below.

EXAMPLE 2

This Example illustrates the use of zinc salicylaldoximate as metal/oxime colour developer.

13.7 g (0.1 mol) of salicylaldoxime were dissolved in a solution of 100 grams of water and 20 g of 40% aqueous sodium hydroxide to give an aqueous solution of sodium salicylaldoximate. A solution of 13.5 g (0.1 mol) of zinc chloride in 30 g of water was added dropwise precipitating zinc salicylaldoximate. To this mix, 60 g of Dinkie A clay (china clay) was added. The resulting formulation had a solids content of 40% and pH of 7.

The formulation was coated onto sheet paper with a laboratory Meyer coater. The resulting sheet was then oven dried to give a dry coatweight of about 12 $gm^{-2}$.

The sheet was separately contacted with 1% solutions of CVL and N-102 in 4:1 partially hydrogenated terphenyl:kerosene. After two minutes, the reflectances of the image and the unimaged area were measured, and the C.I. determined as described in Example 1. In addition, imaged samples were placed in the fade cabinet described in Example 1 for 15 hours, and the intensity was determined again. The results are set out in Table 2, the faded C.I. values in brackets.

EXAMPLE 3

Colour forming reactions between chromogenic materials and mixtures of a metal salt and salicylaldoxime were further investigated by placing 0.1 g of ground mixtures of the metal salt and oxime on spotting tiles and separately contacting them with 1% solutions of CVL, N-102 and BLASB, in each of the following solvents:

A: 2:1 Partially hydrogenated terphenyl:kerosene
B: 2:1 Dioctylphthalate:kerosene
C: Chloroform
D: Toluene Colour formation occurred with every mixture and the intensity was visually assessed two minutes after contact on a scale from 1 to 3, the higher the number the higher the intensity. The coloured samples were also placed in the fade cabinet described in Example 1 for 3 hours and the intensity was then re-assessed. The results are set out in Table 3 below, the faded intensity is given in brackets. The metal salts used are given in Table 3a below.

EXAMPLE 4

Example 3 was repeated using white card as the substrate instead of spotting tiles. Colour formation occurred with every mixture and the intensity (before and after fade) was visually assessed as described in Example 3. The results are set out in Table 4, the faded intensity is given in brackets.

EXAMPLE 5

Colour forming reactions between the chromogenic solutions used in Example 3 and mixtures of zinc sulphate ($ZnSO_4.7H_2O$) and various oximes at a 1:1 molar ratio were carried out by placing 0.1 g of the ground mixtures on spotting tiles and then contacting them with the chromogenic solutions. Colour formation occurred with every mixture and the intensity (before and after fade) was visually assessed as described in Example 3. The results are set out in Table 5 below, the faded intensity is given in brackets.

EXAMPLE 6

Example 5 was repeated but using mixtures of zinc sulphate ($ZnSO_4.7H_2O$) and pairs of oximes, at a molar ratio of 2:1:1 zinc sulphate:oxime:oxime, as the colour developer. Colour formation occurred in every instance and the intensity (before and after fade) was visually assessed as described in Example 3. The results are set out in Table 6 below, the faded intensity is given in brackets.

EXAMPLE 7

A coating formulation was made up with the following ingredients:

| Ingredients | Amount (parts) |
|---|---|
| Salicylaldoxime | 13.7 |
| Zinc Chloride | 13.7 |
| Dow latex binder (50% solids) | 10.0 |
| Sodium Hydroxide (40%) | 10.0 |
| Water | 139.0 |

To this formulation was added 0.28 g of cupric chloride ($CuCl_2.2H_2O$) (ca 2% by weight of salicylaldoxime) and the pH was adjusted to 7 using a solution of sodium hydroxide and ammonia. The resulting formulation, having a solids content of 38.7%, was coated on to sheet paper with a laboratory Meyer coater. The coated sheets were then oven dried to give a dry coatweight of 9 $gm^{-2}$. In a similar manner coated sheets were prepared except that no cupric chloride was added to the formulation.

A coated sheet of each type was contacted with a solution of 1% of each of both CVL and BLASB in 2:1 partially hydrogenated terphenyl:kerosene. After two minutes, the C.I. of the images were determined as described in Example 1. The imaged samples were then placed in the fade cabinet described in Example 1 for 15 hours and the intensities determined again. Then results are set out below.

| Formulation | Colour Intensity Initial | Faded |
|---|---|---|
| with cupric chloride | 47.7 | 66.3 |
| without cupric chloride | 51.7 | 72.4 |

EXAMPLE 8

Colour forming reactions between a 1% solution of CVL in partially hydrogenated terphenyl:kerosene (4:1), salicylaldoxime and various mixtures of a metal oxide and salicylaldoxime at a 1:1 molar ratio were carried out by the procedure used in Example 4. A blue colour was produced in every instance and the intensity was visually assessed on a scale from 1 to 3, the higher the number the intensity. The results are set out below.

| Metal | Intensity |
|---|---|
| Zn | 3 |
| Mg | 3 |
| (None) | 2 |

TABLE 1

| FORMULATION | | CVL | N-102 | BLASB |
|---|---|---|---|---|
| A - | 2 min | 50.6 | 37.1 | 95 |
| | 30 min | 50.5 | 31.4 | 62.2 |
| | 90 min | 54.5 | 30.8 | 58.9 |
| | 180 min | 55.3 | 31.9 | 39.3 |
| B - | 2 min | 50.4 | 37.8 | 95 |
| | 30 min | 53.4 | 34.0 | 69.3 |
| | 90 min | 54.7 | 33.7 | 54.1 |
| | 180 min | 56.3 | 33.9 | 44.4 |
| C - | 2 min | 39.4 | 35.5 | |
| | 30 min | 44.2 | 30.8 | |
| | 90 min | 51.7 | 30.6 | |
| | 180 min | 58.0 | 30.4 | |

TABLE 2

| CHROMOGENIC MATERIAL | INTENSITY 2 MINS | 15 HOURS |
|---|---|---|
| CVL | 34 | 34 |
| N-102 | 33 | 29 |

TABLE 3

| METAL SALT NO. | CVL | | | | N-102 | | | | BLASB | | | |
|---|---|---|---|---|---|---|---|---|---|---|---|---|
| (see Table 3a) | A | B | C | D | A | B | C | D | A | B | C | D |
| 1. | 3(2) | 1(1) | 3(3) | 3(3) | 3(3) | 3(3) | 3(3) | 3(2) | 1(3) | 1(3) | 1(3) | 1(3) |
| 2. | 2(2) | 2(3) | 3(3) | 3(3) | 3(3) | 3(3) | 3(3) | 3(2) | 0(3) | 1(3) | 1(3) | 1(2) |
| 3. | 3(1) | 1(0) | 3(2) | 3(3) | 3(3) | 3(3) | 3(3) | 3(2) | 1(3) | 2(3) | 1(3) | 1(3) |
| 4. | 3(1) | 1(0) | 3(1) | 2(2) | 3(3) | 3(3) | 3(3) | 3(3) | 1(2) | 1(3) | 1(3) | 1(3) |
| 5. | 3(1) | 2(1) | 2(1) | 2(2) | 3(3) | 3(2) | 3(3) | 3(3) | 1(1) | 0(1) | 1(2) | 1(1) |
| 6. | 1(1) | 1(1) | 1(1) | 2(2) | 3(3) | 3(1) | 3(2) | 3(3) | 0(1) | 0(1) | 0(0) | 1(1) |
| 7. | 2(2) | 2(2) | 3(3) | 3(3) | 3(3) | 3(3) | 3(3) | 3(2) | 1(3) | 1(3) | 1(3) | 1(3) |
| 8. | 2(2) | 3(3) | 3(3) | 3(3) | 3(3) | 3(3) | 3(3) | 3(2) | 2(3) | 1(3) | 1(3) | 1(3) |
| 9. | 2(2) | 2(2) | 3(3) | 3(3) | 3(3) | 3(3) | 3(3) | 3(3) | 1(2) | 2(3) | 1(3) | 1(3) |
| 10. | 3(3) | 3(3) | 3(3) | 3(3) | 3(3) | 3(3) | 3(3) | 3(2) | 1(3) | 2(3) | 1(3) | 3(3) |
| 11. | 2(2) | 2(2) | 3(3) | 3(3) | 3(3) | 3(3) | 3(3) | 3(2) | 1(2) | 1(2) | 1(2) | 1(3) |
| 12. | 2(2) | 2(2) | 3(3) | 3(3) | 3(3) | 3(3) | 3(34 | 3(2) | 1(3) | 1(1) | 0(2) | 1(3) |
| 13. | 1(1) | 1(0) | 3(3) | 1(2) | 3(3) | 3(3) | 3(2) | 3(2) | 1(1) | 0(3) | 1(0) | 0(1) |
| 14. | 3(1) | 2(1) | 3(3) | 3(2) | 2(3) | 3(3) | 3(3) | 3(3) | 0(1) | 0(0) | 0(0) | 1(1) |
| 15. | 2(2) | 2(2) | 3(3) | 2(3) | 3(3) | 3(1) | 3(2) | 2(1) | 0(2) | 1(2) | 1(2) | 1(2) |
| 16. | 1(1) | 1(1) | 3(3) | 1(2) | 2(1) | 2(1) | 3(2) | 2(1) | 1(1) | 2(2) | 1(2) | 1(2) |
| 17. | 3(3) | 3(3) | 3(3) | 3(3) | 3(3) | 3(2) | 3(3) | 3(3) | 0(1) | 1(3) | 1(3) | 1(2) |
| 18. | 3(3) | 3(2) | 3(3) | 3(3) | 3(3) | 3(3) | 3(3) | 3(3) | 2(3) | 1(3) | 1(3) | 1(3) |

TABLE 3-continued

| METAL SALT NO. | CVL | | | | N-102 | | | | BLASB | | | |
|---|---|---|---|---|---|---|---|---|---|---|---|---|
| (see Table 3a) | A | B | C | D | A | B | C | D | A | B | C | D |
| 19. | 3(3) | 1(1) | 3(3) | 2(3) | 3(3) | 3(3) | 3(3) | 3(3) | 3(3) | 2(3) | 1(3) | 1(3) |

TABLE 3A

| No. | Name | Formula |
|---|---|---|
| 1. | Aluminium nitrate | $Al(NO_3)_3$ |
| 2. | Calcium nitrate | $Ca(NO_3)_2$ |
| 3. | Cobaltous nitrate | $Co(NO_3)_2.6H_2O$ |
| 4. | Chromic nitrate | $Cr(NO_3)_3.9H_2O$ |
| 5. | Cupric chloride | $CuCl_2.2H_2O$ |
| 6. | Ferric nitrate | $Fe(NO_2)_3.9H_2O$ |
| 7. | Potassium chloride | KCl |
| 8. | Magnesium nitrate | $Me(NO_3)_2.6H_2O$ |
| 9. | Manganese sulphate | $MnSO_4.4H_2O$ |
| 10. | Dodeca-Molybdophosphoric acid | $12\ MoO_3.H_3PO_4.13H_2O$ |
| 11. | Sodium nitrate | $NaNO_3$ |
| 12. | Niobium oxide | $Nb_2O_5$ |
| 13. | Nickel nitrate | $Ni(NO_3)_2.6H_2O$ |
| 14. | Stannous chloride | $SnCl_2$ |
| 15. | Tantalum pentoxide | $Ta_2O_5$ |
| 16. | Titanium dioxide | $TiO_2$ |
| 17. | Dodeca-Tungstophosphoric acid | $12WO_3.H_3PO_4.xH_2O$ |
| 18. | Zinc nitrate. | $Zn(NO_3)_2.6H_2O$ |
| 19. | Zirconium nitrate | $Zr(NO_3)_2.5H_2O$ |

TABLE 4a

| No. | Names |
|---|---|
| 1 | Aluminium nitrate<br>Magnesium nitrate |
| 2 | Aluminium nitrate<br>Zinc nitrate |
| 3 | Aluminium nitrate<br>Zirconium nitrate |
| 4 | Sodium nitrate<br>Calcium nitrate |
| 5 | Sodium nitrate<br>Manganese sulphate |
| 6 | Potassium chloride<br>Dodeca-Molybdophosphoric acid |
| 7 | Tantalum pentoxide<br>Magnesium nitrate |
| 8 | Niobium nitrate<br>Cobaltous nitrate |
| 9 | Niobium oxide<br>Zirconium nitrate |
| 10 | Titanium dioxide<br>Calcium nitrate |
| 11 | Titanium dioxide<br>Manganese sulphate |
| 12 | Titanium dioxide<br>Dodeca-Molybdophosphoric acid |

TABLE 4

| METAL SALT NO. | CVL | | | | N-102 | | | | BLASB | | | |
|---|---|---|---|---|---|---|---|---|---|---|---|---|
| (see Table 4a) | A | B | C | D | A | B | C | D | A | B | C | D |
| 1. | 3(3) | 3(3) | 3(2) | 3(2) | 3(3) | 3(3) | 3(3) | 3(2) | 1(3) | 1(3) | 1(3) | 2(2) |
| 2. | 3(3) | 3(2) | 3(2) | 3(2) | 3(3) | 3(3) | 3(3) | 3(3) | 1(3) | 1(3) | 1(3) | 2(2) |
| 3. | 3(3) | 3(3) | 2(3) | 3(2) | 3(3) | 3(1) | 3(3) | 3(3) | 1(3) | 1(3) | 1(3) | 2(2) |
| 4. | 3(1) | 3(3) | 3(3) | 3(2) | 3(3) | 3(3) | 3(3) | 3(2) | 1(3) | 1(3) | 1(2) | 2(2) |
| 5. | 3(3) | 3(3) | 3(3) | 3(3) | 3(3) | 3(3) | 3(3) | 3(2) | 1(3) | 1(3) | 3(3) | 2(3) |
| 6. | 3(2) | 3(2) | 3(3) | 3(2) | 3(3) | 3(3) | 3(3) | 3(2) | 1(2) | 3(3) | 3(3) | 2(3) |
| 7. | 3(1) | 3(2) | 3(3) | 3(2) | 3(3) | 3(3) | 3(3) | 3(2) | 3(2) | 1(3) | 1(3) | 2(3) |
| 8. | 0(1) | 0(0) | 2(3) | 3(2) | 3(3) | 3(1) | 3(3) | 3(2) | 0(2) | 1(2) | 1(3) | 2(2) |
| 9. | 2(3) | 1(2) | 2(2) | 3(2) | 3(2) | 3(2) | 3(3) | 3(2) | 2(3) | 2(3) | 2(2) | 3(2) |
| 10. | 3(2) | 3(1) | 3(3) | 3(3) | 3(3) | 3(1) | 3(3) | 3(3) | 1(3) | 1(2) | 2(3) | 3(3) |
| 11. | 3(3) | 3(3) | 3(3) | 3(3) | 3(3) | 3(1) | 3(3) | 3(3) | 1(3) | 2(3) | 3(3) | 3(3) |
| 12. | 3(3) | 3(3) | 3(3) | 3(2) | 3(3) | 3(2) | 3(3) | 3(3) | 3(3) | 3(3) | 3(3) | 3(3) |

TABLE 5

| OXIME | CVL | | | | N-102 | | | | BLASB | | | |
|---|---|---|---|---|---|---|---|---|---|---|---|---|
| | A | B | C | D | A | B | C | D | A | B | C | D |
| Acetone oxime | 9(1) | 9(2) | 2(1) | 2(1) | 2(2) | 1(3) | 3(1) | 2(1) | 0(3) | 0(3) | 0(1) | 0(2) |
| Acetaldehyde oxime | 2(1) | 1(2) | 3(1) | 3(1) | 3(1) | 3(3) | 3(1) | 3(1) | 1(3) | 0(3) | 0(1) | 1(1) |
| Acetophenone oxime | 1(2) | 1(1) | 2(3) | 2(1) | 2(2) | 2(3) | 2(2) | 2(2) | 1(3) | 1(3) | 0(3) | 0(2) |
| Diacetyl monoxime | 3(2) | 1(1) | 2(1) | 2(1) | 2(2) | 2(3) | 3(10 | 2(1) | 1(3) | 1(1) | 2(3) | 2(1) |
| Glyoxime | 1(1) | 1(1) | 1(1) | 2(1) | 1(2) | 2(3) | 1(1) | 1(1) | 0(3) | 0(1) | 1(3) | 0(1) |
| Dimethyl glyoxime | 1(2) | 2(1) | 1(1) | 1(1) | 1(1) | 1(3) | 1(1) | 1(1) | 0(2) | 0(1) | 0(3) | 0(1) |
| Diphenyl glyoxime | 1(0) | 1(0) | 1(1) | 1(1) | 1(3) | 1(3) | 3(3) | 2(2) | 0(2) | 0(2) | 0(2) | 0(2) |
| Alpha-furildioxime | 1(1) | 1(1) | 1(1) | 1(1) | 1(3) | 1(3) | 1(2) | 1(1) | 0(1) | 0(1) | 0(3) | 0(1) |
| 2-Hydroxy-5-nonyl acetophenone oxime | 0(0) | 0(0) | 3(3) | 3(3) | 0(3) | 0(3) | 3(3) | 3(3) | 0(1) | 0(3) | 0(3) | 0(3) |
| Salicylaldoxime | 3(3) | 3(3) | 3(3) | 3(3) | 3(3) | 3(3) | 3(3) | 3(3) | 1(3) | 1(3) | 2(3) | 2(3) |
| Benzoinoxime | 1(1) | 1(1) | 2(2) | 2(2) | 1(3) | 2(3) | 3(2) | 2(1) | 0(3) | 0(2) | 0(3) | 0(2) |
| 1-Phenyl-1,2-propanedione-2-oxime | 2(1) | 1(1) | 1(1) | 2(1) | 1(2) | 1(3) | 2(1) | 2(1) | 0(3) | 1(2) | 1(3) | 1(2) |
| Nioxime | 0(1) | 0(1) | 1(1) | 1(1) | 1(3) | 1(3) | 2(1) | 2(1) | 0(2) | 0(1) | 0(3) | 0(1) |
| Violuric acid | 0(1) | 0(0) | 0(1) | 0(1) | 1(3) | 2(3) | 2(1) | 2(1) | 0(2) | 0(1) | 0(2) | 0(1) |
| Salicylhydroxamic acid | 2(2) | 1(2) | 2(2) | 2(1) | 2(2) | 2(2) | 3(2) | 3(2) | 0(3) | 0(2) | 0(3) | 0(2) |

TABLE 6

| OXIMES | CVL | | | | N-102 | | | | BLASB | | | |
|---|---|---|---|---|---|---|---|---|---|---|---|---|
| | A | B | C | D | A | B | C | D | A | B | C | D |
| Biacetyl monoxime | 1(0) | 1(1) | 2(1) | 1(1) | 1(3) | 1(3) | 3(3) | 3(3) | 1(3) | 1(3) | 1(1) | 1(2) |
| Diphenyl glyoxime | | | | | | | | | | | | |

TABLE 6-continued

| OXIMES | CVL | | | | N-102 | | | | BLASB | | | |
|---|---|---|---|---|---|---|---|---|---|---|---|---|
| | A | B | C | D | A | B | C | D | A | B | C | D |
| Diphenyl glyoxime Salicylaldoxime | 3(1) | 3(0) | 2(3) | 3(3) | 3(3) | 3(3) | 3(3) | 3(3) | 2(3) | 1(3) | 2(2) | 2(1) |
| Biacetyl monoxime Salicylaldoxime | 3(3) | 3(2) | 3(3) | 3(3) | 3(3) | 3(3) | 3(3) | 3(3) | 2(3) | 2(3) | 2(3) | 3(2) |
| Benzoinoxime Biacetyl monoxime | 1(2) | 1(2) | 3(3) | 2(2) | 1(3) | 1(3) | 3(3) | 3(2) | 1(3) | 1(3) | 2(2) | 1(1) |
| Diphenyl glyoxime Benzoinoxime | 1(0) | 1(0) | 2(1) | 1(1) | 1(3) | 1(3) | 3(3) | 2(2) | 1(2) | 1(3) | 2(2) | 1(2) |
| Benzoinoxime Salicylaldoxime | 3(3) | 3(3) | 3(2) | 3(3) | 3(3) | 2(3) | 3(3) | 3(2) | 2(2) | 12(3) | 3(2) | 3(1) |

I claim:

1. Pressure sensitive record material in which the colour forming reaction is produced from a substantially colourless chromogenic material capable of acquiring a positive charge to produce its coloured form and a metal/oxime colour developer capable of engendering the acquisition of a positive charge by the chromogenic material, the chromogenic material and the colour developer being isolated from each other by a pressure sensitive barrier.

2. Record material as claimed in claim 1 wherein the oxime is a monoxime of the formula (I):

$$(R_1)(R_2).C{=}N{-}OH \qquad (I)$$

wherein $R_1$ and $R_2$ are the same or different and each represents a hydrogen atom; an alkyl group; an aryl group which is optionally substituted by one or more hydroxy and/or alkyl and/or aralkyl and/or alkoxy and/or halo substituent(s); an aroyl group; an acyl group; an aralkyl group; a hydroxy group; or $R_1$ and $R_2$ together with the carbon atom to which they are bonded represent an alicyclic or heterocyclic ring.

3. Record material as claimed in claim 2 wherein the oxime is salicylaldoxime or a ring substituted derivative thereof.

4. Record material as claimed in claim 1 wherein the oxime is a dioxime of the formula (II):

$$HO{-}N{=}C(R_3){-}(R_4)C{=}N{-}OH \qquad (II)$$

wherein $R_3$ and $R_4$ are the same or different and each represents a hydrogen atom; an alkyl group; an aryl group; a furyl group or $R_3$ and $R_4$ together represent a $C_1$ to $C_{10}$ alkylene group.

5. Record material as claimed in claim 1 wherein the metal is zinc.

6. Record material as claimed in claim 5 wherein the metal/oxime colour developer is or includes a metal oximate.

7. Record material as claimed in claim 6 wherein the metal oximate is diphenyl glyoximate, benzaldoximate of zinc or a substituted or an unsubstituted salicylaldoximate.

8. Heat sensitive record material in which the colour forming reaction is produced from a substantially colourless chromogenic material capable of acquiring a positive charge to produce its coloured form and a metal/oxime colour developer capable of engendering the acquisition of a positive charge by the chromogenic material the chromogenic material or the colour developer or another component being capable of melting and/or vaporising at a thermographically suitable temperature to allow the colour forming reaction to take place.

9. Record material as claimed in claim 8 wherein the oxime is a monoxime of the formula (I):

$$(R_1)(R_2).C{=}N{-}OH \qquad (I)$$

wherein $R_1$ and $R_2$ are the same or different and each represents a hydrogen atom; an alkyl group; an aryl group which is optionally substituted by one or more hydroxy and/or alkyl and/or aralkyl and/or alkoxy and/or halo substituent(s); an aroyl group; an acyl group; an aralkyl group; a hydroxy group; or $R_1$ and $R_2$ together with the carbon atom to which they are bonded represent an alicyclic or heterocyclic ring.

10. Record material as claimed in claim 8 wherein the oxime is a dioxime of the formula (II):

$$HO{-}N{=}C(R_3){-}(R_4)C{=}N{-}OH \qquad (II)$$

wherein $R_3$ and $R_4$ are the same or different and each represents a hydrogen atom; an alkyl group; an aryl group; a furyl group or $R_3$ and $R_4$ together represent a $C_1$ to $C_{10}$ alkylene group.

* * * * *